US006328103B1

(12) United States Patent
Pahmiyer et al.

(10) Patent No.: US 6,328,103 B1
(45) Date of Patent: Dec. 11, 2001

(54) METHODS AND APPARATUS FOR DOWNHOLE COMPLETION CLEANUP

(75) Inventors: Robert C. Pahmiyer, Houston; Paul David Ringgenberg, Carrollton, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/465,419

(22) Filed: Dec. 16, 1999

Related U.S. Application Data

(63) Continuation-in-part of application No. 09/378,124, filed on Aug. 19, 1999.

(51) Int. Cl.[7] ..... E21B 47/00

(52) U.S. Cl. ..... 166/250.17; 166/264; 166/278; 166/387; 166/68.5; 166/74; 166/77.2; 166/106; 166/147; 166/148; 166/184; 175/59; 73/152.29; 73/152.39; 73/152.42

(58) Field of Search ..... 166/250.01, 250.17, 166/264, 278, 384, 387, 54.1, 68.5, 74, 77.2, 101, 106, 131, 228, 142, 147, 148, 184; 175/40, 50, 57, 58, 59; 73/152.18, 152.29, 152.39, 152.42, 152.36

(56) References Cited

U.S. PATENT DOCUMENTS

| | | | |
|---|---|---|---|
| 2,169,559 | | 8/1939 | Halliburton . |
| 2,945,952 | * | 7/1960 | Bourne et al. . |
| 3,437,138 | | 4/1969 | Scott . |
| 3,923,099 | * | 12/1975 | Brandon . |
| 4,043,129 | * | 8/1977 | McCabe et al. . |
| 4,112,745 | * | 9/1978 | McCabe et al. . |
| 4,210,025 | | 7/1980 | Bimond et al. . |
| 4,787,447 | | 11/1988 | Christensen . |
| 4,878,538 | | 11/1989 | Christensen . |
| 4,883,123 | | 11/1989 | Zunkel et al. . |
| 5,335,732 | | 8/1994 | McIntyre . |
| 5,456,322 | * | 10/1995 | Tucker et al. . |
| 5,484,018 | | 1/1996 | Cavender et al. . |
| 5,497,832 | * | 3/1996 | Stuebinger et al. . |
| 5,540,280 | | 7/1996 | Schultz et al. . |
| 5,799,733 | | 9/1998 | Ringgenberg et al. . |
| 5,803,178 | * | 9/1998 | Cain . |

FOREIGN PATENT DOCUMENTS

| | | |
|---|---|---|
| 0781893 A2 | 7/1997 | (EP) . |
| 0699819 A3 | 12/1997 | (EP) . |
| 2172631A | 9/1986 | (GB) . |
| 2221486A | 2/1990 | (GB) . |
| WO 00/58604 | 10/2000 | (WO) . |

OTHER PUBLICATIONS

Halliburton Reservoir Services PTS Tool Systems and Fast Test Technique by Roger L. Schultz, undated.
Operating Instructions 2⅜ in. and 2⅝ in 3 omega Plug Catcher, dated Feb. 15, 1981.
Latch–Down Plugs, dated Jan. 31, 1981.
Cementing Plug Latch Down dated Feb. 15, 1981.
Petroleum Engineering Drilling and Well Completious Prentice–Hall Inc., Table of Contents and pp. 253–268; written by Carl Gatliu; dated 1960.
United Kingdom Search Report Application No.: GB0030648.0.

* cited by examiner

*Primary Examiner*—Roger Schoeppel
(74) *Attorney, Agent, or Firm*—William M. Imwalle; Marlin R. Smith

(57) ABSTRACT

A method of performing a downhole well completion cleanup is provided. In a described embodiment, completion fluids from a first zone are flowed into a tubular string, and then the fluids are discharged into a second zone. An apparatus usable in the method is provided, in which a downhole pump is utilized to pump the fluids from one zone to the other. The pump may be operated in a variety of manners. The apparatus may also include fluid identification sensors and telemetry devices for monitoring the progress of the cleanup operation.

58 Claims, 6 Drawing Sheets

METHODS AND APPARATUS FOR DOWNHOLE COMPLETION CLEANUP

CROSS-REFERENCE TO RELATED APPLICATION

The present application is a continuation-in-part of prior copending application Ser. No. 09/378,124, filed Aug. 19, 1999, the disclosure of which is incorporated herein by this reference.

BACKGROUND OF THE INVENTION

The present invention relates generally to operations performed in conjunction with subterranean wells and, in an embodiment described herein, more particularly provides a method and apparatus for performing a completion cleanup operation downhole.

Just prior to placing a well in production after a gravel packing operation or stimulation treatment therein, it is common practice to remove completion fluids from a hydrocarbon-bearing zone intersected by the well. In the usual situation, a substantial portion of the completion fluids in the zone are deposited there as a result of the gravel packing or stimulation treatment. If no gravel packing or stimulation treatments have been performed, then the completion fluids in the zone may be mud or other fluids introduced into the well during drilling or completion of the well. As used herein, the term "completion fluid" is used to indicate fluid which is introduced into a zone from a source other than the zone during drilling or completion of a well intersecting the zone.

Generally, the completion cleanup operation is accomplished by transporting an extensive amount of temporary production and fluid handling equipment to the well. This equipment may include temporary piping, manifolds, test heads, separators, line heaters, tanks, burner booms, etc. The temporary equipment is typically used because there is not yet any permanent production equipment installed at the well or the permanent production equipment is not designed to handle the cleanup operation.

The temporary equipment is rigged up on location and the well is flowed until all or most of the completion fluid has been removed from the hydrocarbon bearing zone. Any hydrocarbons produced in this operation may be burned off or otherwise disposed of, thereby creating safety and environmental problems. The completion fluids must also be disposed of, which is an additional environmental problem and adds to the expense of the operation.

From the foregoing, it can be seen that it would be quite desirable to provide an improved method of performing a completion cleanup operation. The improved method should not require that completion fluids and/or hydrocarbons be disposed of at the surface, and the method should be more economical, convenient to perform and safer than past cleanup operations. It is accordingly an object of the present invention to provide such an improved method, and an apparatus useful in performing the method.

SUMMARY OF THE INVENTION

In carrying out the principles of the present invention, in accordance with an embodiment thereof, a method is provided in which a completion cleanup operation is performed downhole. The method does not require an extensive amount of temporary equipment to be transported and installed at a well, does not require the burning of hydrocarbons at the surface, and does not require disposal at the surface of hydrocarbons and/or completion fluids. Apparatus which may be used in the method is also provided.

In one aspect of the present invention, a method is provided in which completion fluids are removed from a hydrocarbon-bearing producing zone and then injected into a disposal zone downhole. In this manner, no significant quantity of hydrocarbons or completion fluids are brought to the surface for disposal. The method may be performed conveniently and economically, with only a limited amount of equipment needed to perform the method. Additionally, the method is compatible with gravel packing, formation fracturing and other well completion operations.

In another aspect of the present invention, a method is provided in which fluid is pumped from a producing zone and into a disposal zone by a downhole pump. Various pumping methods may be utilized. For example, a hydraulic motor, which operates in response to fluid flowed therethrough, may be conveyed into the well by coiled tubing. The motor may be connected to a pump, so that when fluid is circulated through the coiled tubing, the pump pumps completion fluid from the producing zone and into the disposal zone. As another example, the downhole pump may be driven by an electric motor connected to a wireline or other electrical conductor.

In yet another aspect of the present invention, instead of pumping fluids from the producing zone to the disposal zone, the fluids are permitted to flow from the producing zone into a tubular string, and then the fluids are pumped from the tubular string into the disposal zone, for example, by a pump located at the surface. When the fluids are flowed into the tubular string, the fluids may be permitted to flow to the surface, where the fluids may be analyzed to determine whether the producing zone has been cleaned up.

In still another aspect of the present invention, an apparatus used in the method may include fluid sensors, including fluid identification sensors, and communication devices for transmitting fluid property information to the surface. In this manner, the fluids flowed from the producing formation may be analyzed downhole, without the need of bringing them to the surface. The communication devices may include telemetry devices, such as acoustic telemetry devices, mud pulse telemetry devices, electromagnetic telemetry devices, etc.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
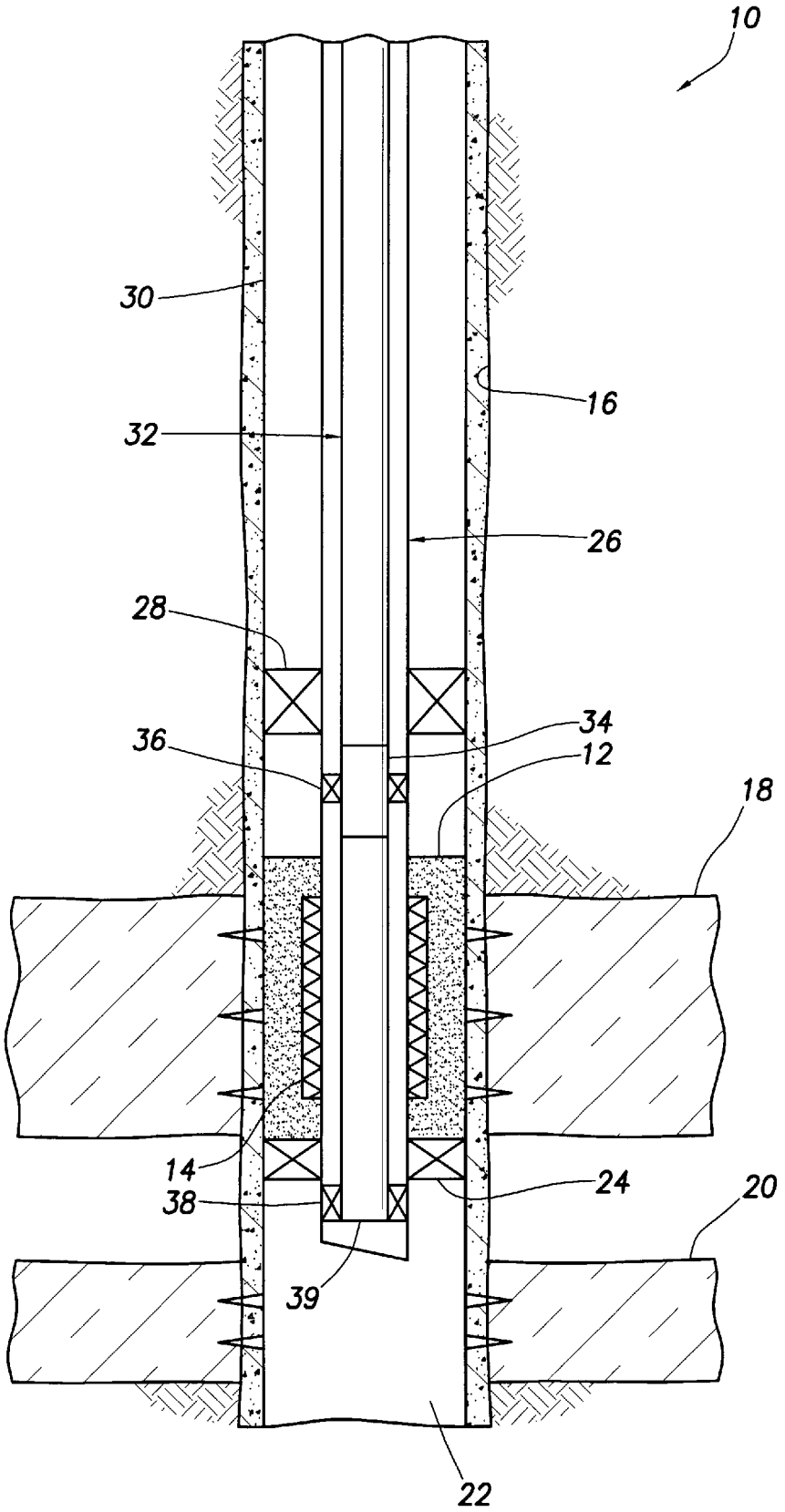
FIG. 1 is a schematic partially cross-sectional view of a first well completion cleanup method embodying principles of the present invention.

Representatively illustrated in FIG. 1 is a completion cleanup method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The method 10 is depicted in FIG. 1 as being performed subsequent to a gravel packed completion, with gravel 12 having been placed about a well screen 14 according to conventional practices well known to those skilled in the art. However, it is to be clearly understood that the method 10 may be performed after other types of well completion operations, without departing from the principles of the present invention.

As representatively illustrated in FIG. 1, a well has been drilled with a wellbore 16 that intersects two zones 18, 20. As used herein, the term "zone" is used to indicate a subterranean formation, or a portion thereof. Therefore, the zones 18, 20 may be portions of a single earth formation, or they may be located in separate formations. Note that a single zone may have hydrocarbon, as well as non-hydrocarbon, fluids therein, such as a zone in which a lower portion contains water and an upper portion contains oil.

In the method 10, the upper zone 18 is a producing zone, that is, a hydrocarbon-bearing zone from which it is desired to produce fluids to the earth's surface. The lower zone 20 is a disposal zone, that is, a zone in which it is desired to dispose of completion fluids drained from the upper zone 18. Of course, it is not necessary for the disposal zone 20 to be located below the producing zone 18, but in the method 10 as depicted in FIG. 1, this configuration is convenient, since the disposal zone is intersected by the rathole 22 below a sump packer 24.

The screen 14 is included in a production tubing string 26 installed in the well and stung into the sump packer 24. The production tubing string 26 may also include another packer 28 above the screen 14. Fluid flowing from the zone 18 into the wellbore 16 is, thus, contained between the packers 24, 28 prior to flowing into the production tubing string 26 through the screen 14. Note that the well is preferably provided with protective casing 30, but the method 10, and other methods described herein, may be practiced in conjunction with an open hole completion, without departing from the principles of the present invention.

To pump completion fluids out of the producing zone 18 and into the disposal zone 20 prior to placing the well in production, a coiled tubing string 32 is lowered into the production tubing string 26. The coiled tubing string 32 includes a pump apparatus 34. However, it is to be understood that means of conveying the pump apparatus 34 other than coiled tubing may be utilized, without departing from the principles of the present invention. For example, segmented tubing may be used, or wireline could be used as described more fully below.

Upper and lower seals 36, 38 are also carried on the tubing string 32. The upper seal 36 is preferably disposed about the pump apparatus 34, and the lower seal 38 is preferably sealingly engaged within the sump packer 24, or a packer bore receptacle attached thereto. The screen 14 is, thus, disposed between the seals 36, 38, so that the pump apparatus 34 may draw fluid inwardly through the screen. If the well were not gravel packed, but had an opening through the production tubing string 26, instead of the screen 14, for receiving fluid from the zone 18, the seals 36, 38 would preferably straddle the opening.

In one important aspect of the present invention, the pump apparatus 34 pumps completion fluid, which may comprise mud exclusively or as a portion thereof, from the upper zone 18 into the tubing string 32, and then out of a lower end 39 of the tubing string and into the lower zone 20. In this manner, no completion fluids or hydrocarbons are burned or otherwise disposed of at the surface.

Figure 2:
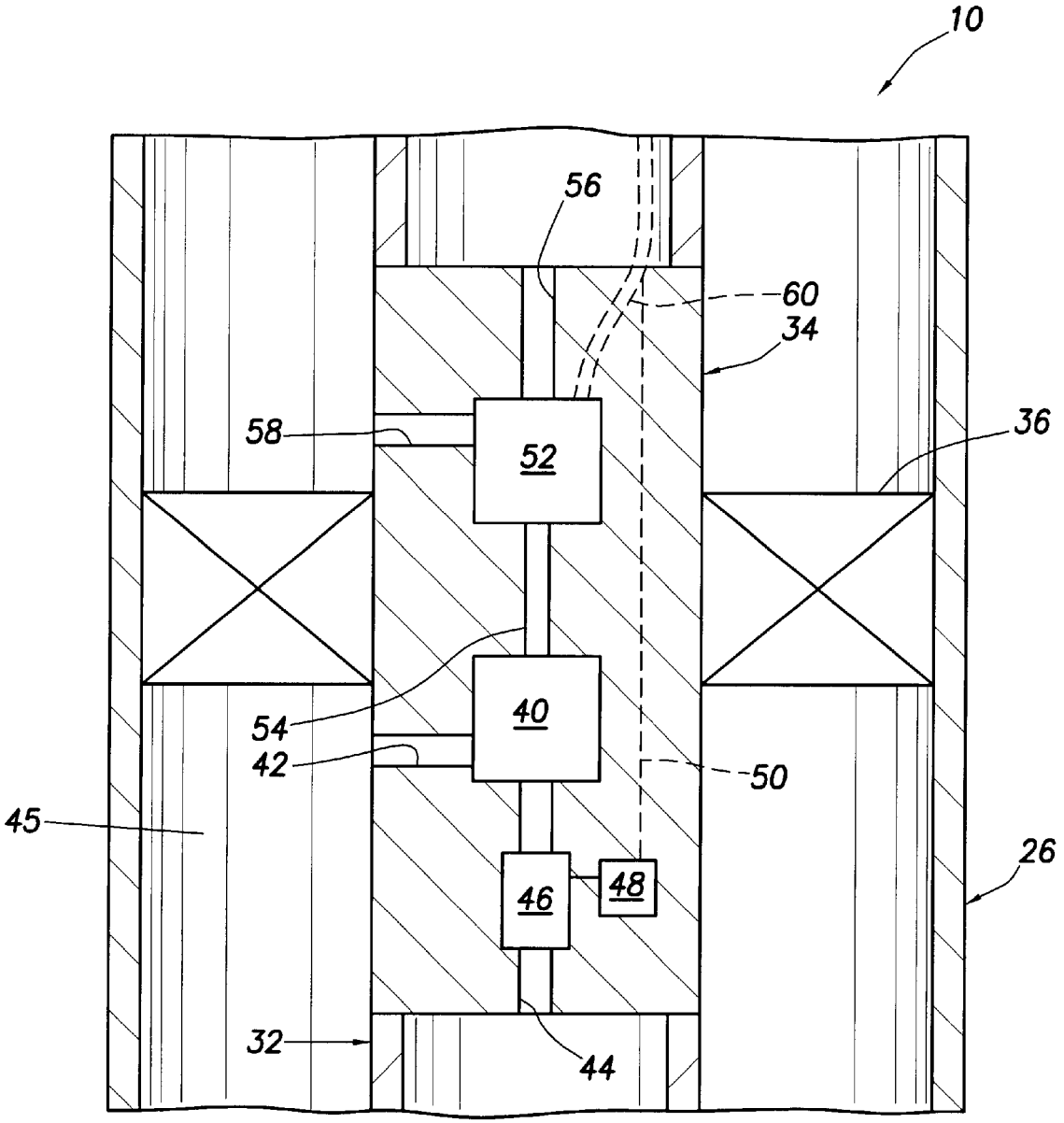
FIG. 2 is an enlarged scale schematic cross-sectional view of an apparatus which may be used in the first method of FIG. 1.

Referring additionally now to FIG. 2, an enlarged cross-sectional view of the pump apparatus 34 is schematically illustrated. The pump apparatus 34 includes a pump 40, an inlet passage 42 and a discharge passage 44. The pump 40 draws fluid from the inlet passage 42, which is in communication with an annular volume 45 between the production tubing 26 and the tubing string 32 below the seal 36. The pump 40 pumps fluid into the discharge passage 44, which is in communication with the interior of the tubing string 32 below the apparatus 34. The discharged fluid eventually exits the lower end 39 of the tubing string 32 and flows into the lower zone 20 as described above.

The pump apparatus 34 may include a fluid property sensor 46 for detecting a property, such as resistivity, conductivity, pressure, temperature, etc., of the fluid being pumped by the pump 40. The sensor 46 enables determination of, among other things, the point at which all or substantially all of the completion fluid has been pumped out of the upper zone 18. The sensor 46 is depicted interconnected in the discharge passage 44, but it could be otherwise positioned without departing from the principles of the present invention.

A communication device or transmitter 48 is connected to the sensor 46. In this manner, indications of fluid properties sensed by the sensor 46 may be transmitted to a remote location, such as the earth's surface, for evaluation, monitoring, etc. For example, an operator at the earth's surface may monitor the fluid property indications and detect when all or substantially all of the completion fluid has been pumped out of the upper zone 18. The operator may then stop the pumping operation, retrieve the tubing string 32 from the well and place the well in production. Alternatively, or in addition, the fluid property indications from the sensor 46 could be stored in a memory device for later retrieval and evaluation.

The communication device 48 may be any conventional type of transmitter known to those skilled in the art. For example, the communication device 48 may communicate with a remote location by acoustic telemetry, electromagnetic telemetry, mud pulse telemetry, etc. Additionally, the communication device 48 may communicate via one or more optional conductors 50, shown in FIG. 2 in dashed lines, extending to a remote location.

The pump 40 is driven by a hydraulic motor 52 via a shaft 54. An inlet passage 56 is in communication with the interior of the tubing string 32 above the apparatus 34, and a discharge passage 58 is in communication with the annular volume 45 above the seal 36. To operate the motor 52, fluid is circulated through the tubing string 32, through the inlet passage 56, through the motor 52, and through the discharge passage 58 into the annular volume 45 above the seal 36.

Of course, other means of operating a motor to drive the pump 40 may be utilized, without departing from the principles of the present invention. For example, the motor 52 could be an electric motor connected to one or more conductors 60. In that case, the seal 36 may not be needed to separate the fluid circulated to operate the motor 52 from the fluid pumped out of the zone 18.

Additionally, other means of controlling the operation of the motor 52, or at least operation of the pump 40, may be used without departing from the principles of the present invention. For example, the sensor 46 may be interconnected to the motor 52 so that, when the sensor detects that all or substantially all of the completion fluid has been pumped out of the zone 18, the motor stops automatically.

Figure 3:
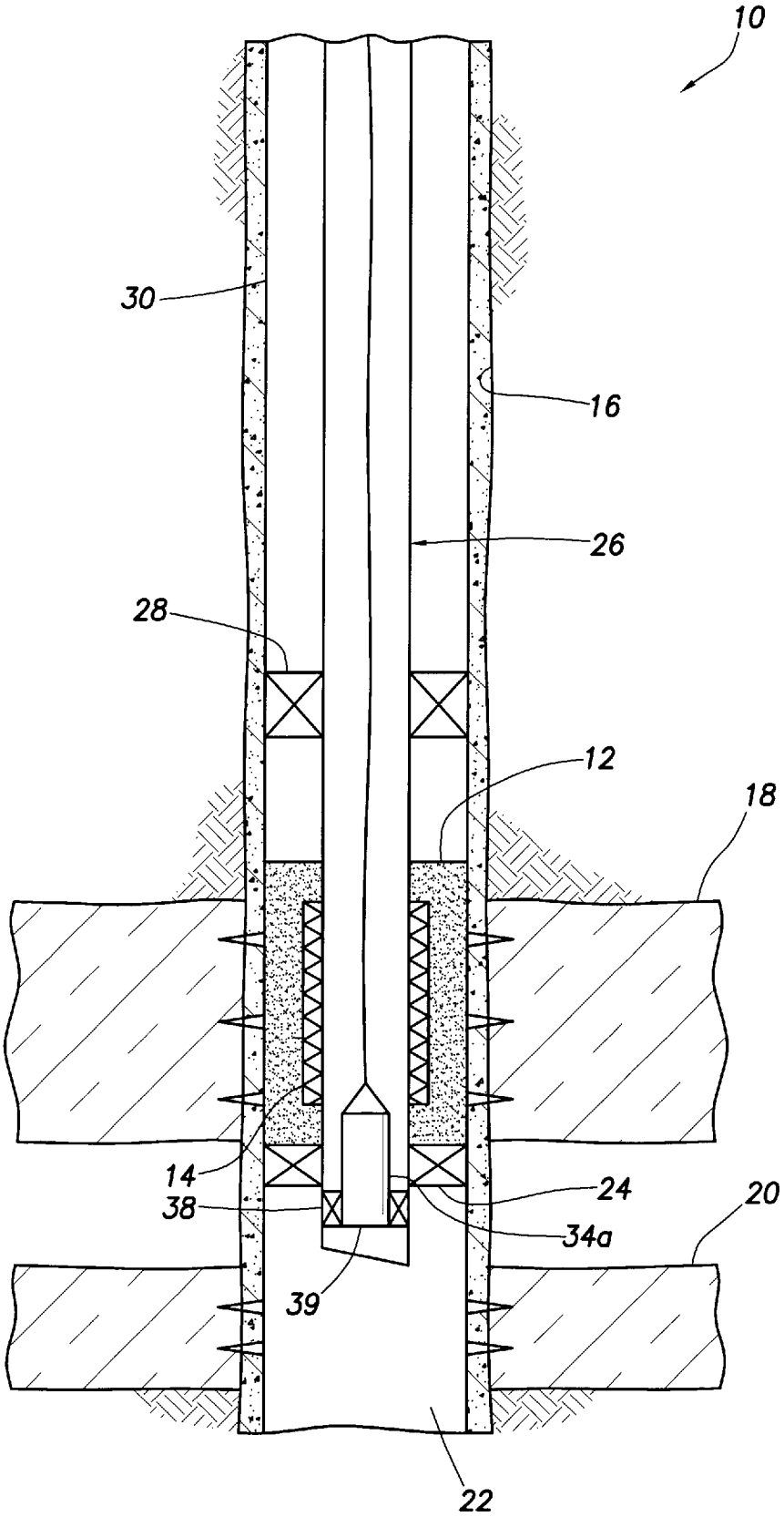
FIG. 3 is a schematic partially cross-sectional view of an alternate configuration usable in the first method of FIG. 1.

Furthermore, means other than the coiled tubing 32 may be used to convey a pump apparatus, such as the apparatus 34, into the well. For example, as mentioned above, a wireline may be used to convey the apparatus 43, in which case the motor 52 may be an electric motor connected to conductors 60 of the wireline and seal 36 would not be needed to separate fluid circulated through the tubing string 32 from fluid pumped from the zone 18. FIG. 3 shows this alternate configuration for use in the method 10, the pump apparatus being designated 34a to indicate that it differs somewhat from the apparatus 34 described above.

Figure 5:
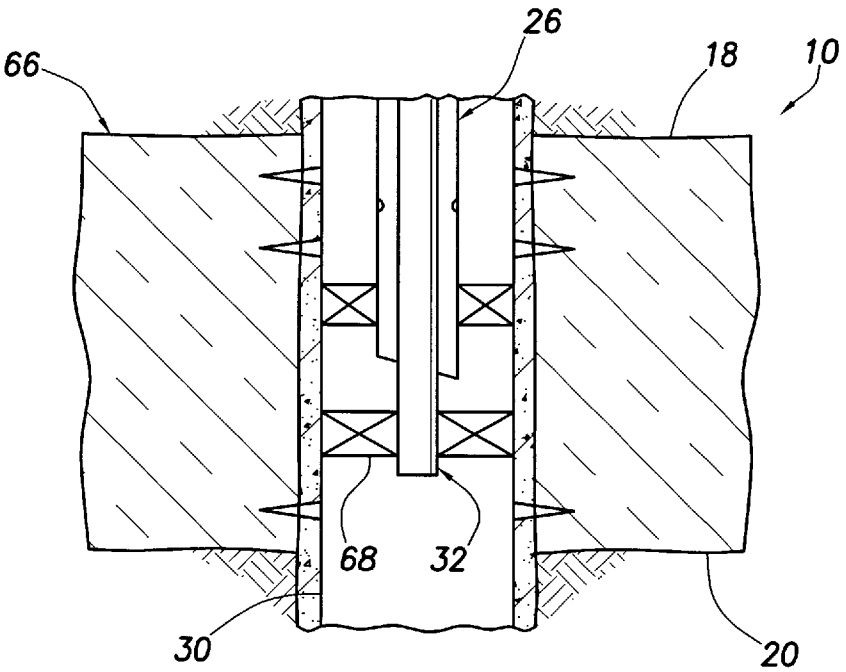
FIG. 5 is a schematic partially cross-sectional view of another alternate configuration usable in the first method of FIG. 1.
Figure 4:
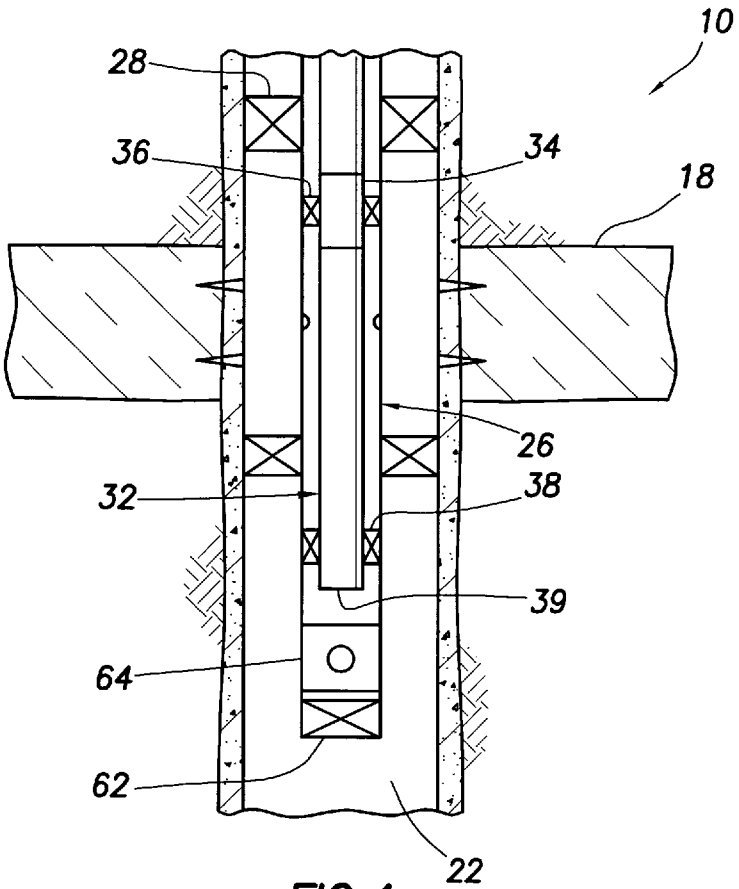
FIG. 4 is a schematic partially cross-sectional view of another alternate configuration usable in the first method of FIG. 1.

Referring additionally now to FIGS. 4 and 5, alternate configurations of the tubing string 32 and production tubing 26 in the method 10 are representatively illustrated. In FIG. 4, the upper zone 18 has not been the subject of a gravel pack completion, and provision is made for closing off the production tubing 26 after the completion cleanup operation. Specifically, the lower end of the production tubing 26 is plugged by a plug 62, and a sliding side door valve 64 selectively permits and prevents flow between the rathole 22 and the interior of the production tubing. During the completion cleanup operation, the valve 64 is open, permitting the pump apparatus 34 to pump completion fluid from the zone 18 to the rathole 22. After the completion cleanup operation, the valve 64 may be closed to isolate the rathole 22 from the production tubing 26. This configuration may be especially useful where the zone 18 is subjected to a stimulation operation, such as formation fracturing, prior to the completion cleanup operation.

In FIG. 5, the tubing string 32 includes a packer 68, such as an inflatable packer, instead of the seal 38. The packer 68 is set in the casing 30 below the production tubing 26 prior to pumping completion fluid out of the zone 18. Additionally, FIG. 5 depicts the zones 18, 20 as portions of a single formation 66. In this manner, completion fluid may be pumped from an upper zone 18 of the formation 66 and into a lower zone 20 of the formation. This may aid in recovery of hydrocarbons from the formation 66, as in conventional water flood operations.

Figure 6A:
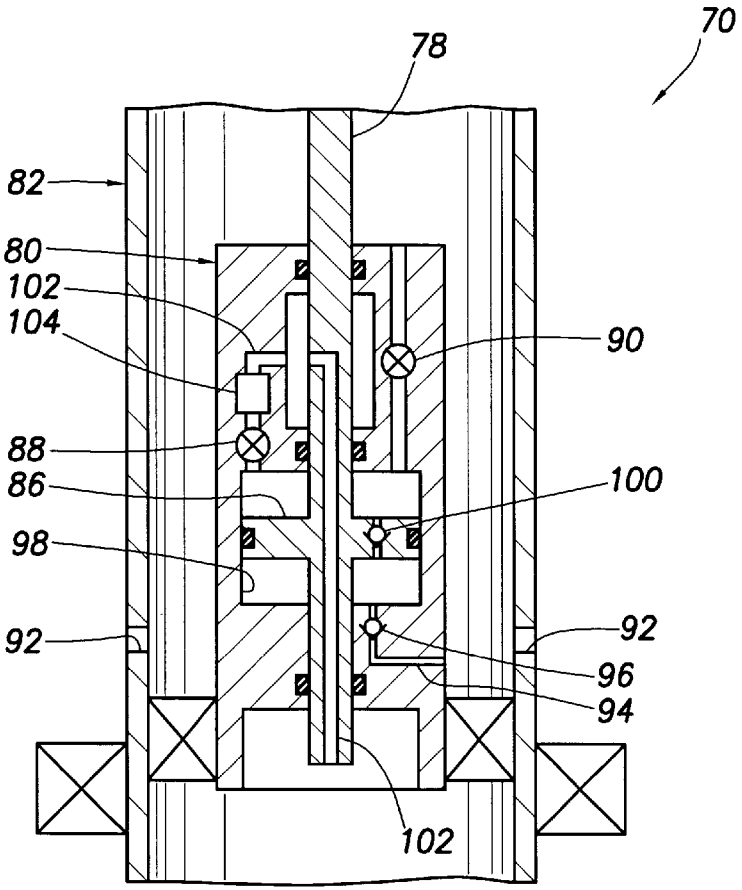
FIG. 6A is an enlarged scale schematic cross-sectional view of an apparatus shown in FIG. 5.
Figure 6:
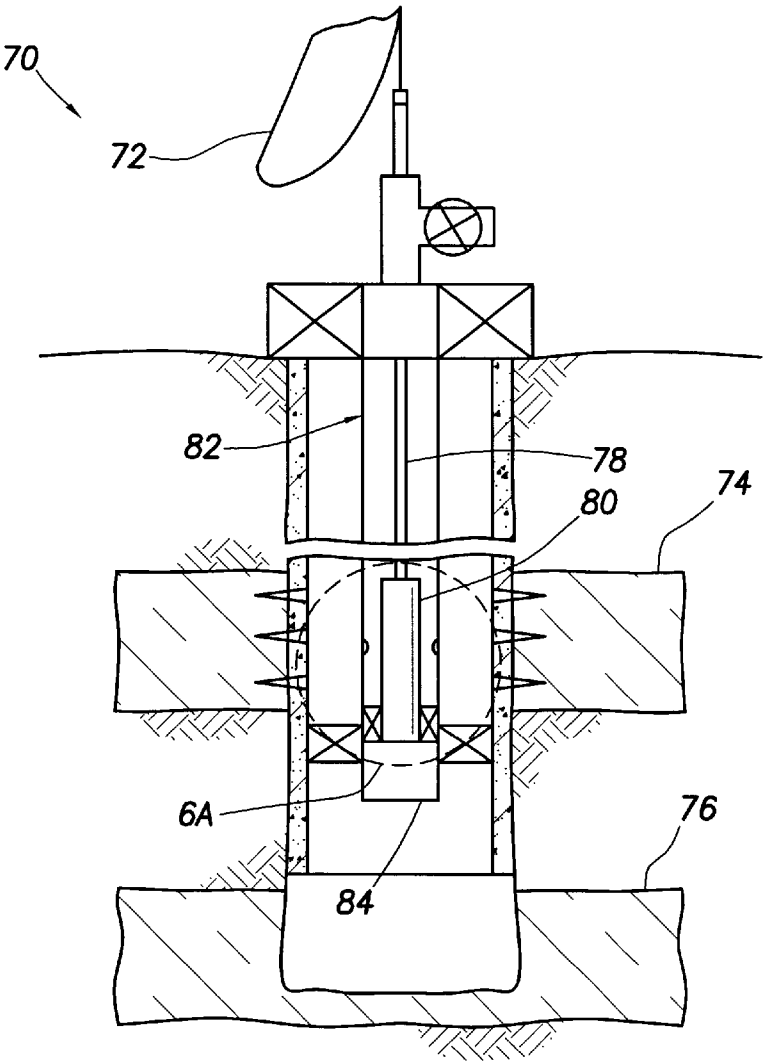
FIG. 6 is a schematic partially cross-sectional view of a second well completion cleanup method embodying principles of the present invention.

Referring additionally now to FIG. 6, another method 70 of performing a cleanup operation embodying principles of the present invention is representatively illustrated. The method 70 is an economical alternative for performing a cleanup operation in those cases in which a pump jack 72 will be used to produce the well. The pump jack 72 is used to pump completion fluid out of a hydrocarbon-bearing producing zone 74 and into a disposal zone 76 and then, after the cleanup operation, the pump jack is used to produce hydrocarbons from the producing zone.

In FIG. 6, the pump jack 72 is depicted connected by sucker rod 78 to a pump apparatus 80 sealingly disposed within a production tubing string 82. The pump apparatus 80 is operated by the pump jack 72 to pump completion fluid out of the zone 74, into the production tubing 82, through the pump apparatus 80, and out a lower end 84 of the production tubing and into the disposal zone 76. An enlarged cross-sectional schematic view of the area encircled by dashed lines in FIG. 6 is shown in FIG. 6A.

In FIG. 6A, it may be seen that the pump apparatus 80 includes a piston 86 connected to the sucker rod 78. The pump jack 72 raises and lowers the sucker rod 78, causing the piston 86 to reciprocate axially in the pump apparatus 80. Valves 88, 90 are used to direct fluid displaced by the piston 86 to either the interior of the production tubing 82 below the apparatus 80, or to the interior of the tubing above the apparatus.

When the piston 86 is displaced upwardly, fluid from the zone 74 is drawn into the production tubing 82 via openings 92, and then into an inlet passage 94 of the pump apparatus 80. A check valve 96 prevents the fluid from flowing back out of the inlet passage 94 when the piston 86 is displaced downwardly.

The fluid drawn into the pump apparatus 80 on the upward stroke of the piston 86 is retained in a cylinder 98 below the piston. When the piston 86 is displaced downwardly, this fluid is forced through a check valve 100 into the cylinder 98 above the piston. When the piston 86 again strokes upwardly, this fluid is forced either through the valve 88 or through the valve 90, depending upon which valve is open.

If the valve 88 is open, the fluid is flowed through a discharge passage 102 when the piston 86 displaces upwardly. The discharge passage 102 extends through the piston 86 and is in communication with the interior of the production tubing 82 below the pump apparatus 80. In this manner, the fluid is pumped through the lower end 84 of the production tubing 82 and outward into the disposal zone 76.

A fluid property sensor 104 may be interconnected in the discharge passage 102 for sensing a property of the fluid pumped through the pump apparatus 80. The sensor 104 may be similar to the sensor 46 described above, and the sensor 104 may be similarly connected to a communication device or transmitter (not shown in FIG. 6A) for communicating indications of fluid properties to a remote location.

If, instead of valve 88 being open, valve 90 is open lo when the piston 86 strokes upwardly, the fluid is discharged into the interior of the production tubing 82 above the apparatus 80. The fluid is, thus, produced to the earth's surface through the production tubing 82 when the valve 90 is open.

Note that the valves 88, 90 may be otherwise configured, for example, as a combined three-way valve, etc., without departing from the principles of the present invention. Additionally, the valves 88, 90 may be interconnected to the fluid property sensor 104 so that, when all or substantially all of the completion fluid has been pumped out of the zone 74, the valve 88 automatically closes and the valve 90 automatically opens. In this manner, the method 70 provides for automatic production from the zone 74 after the completion cleanup operation.

Figure 7:
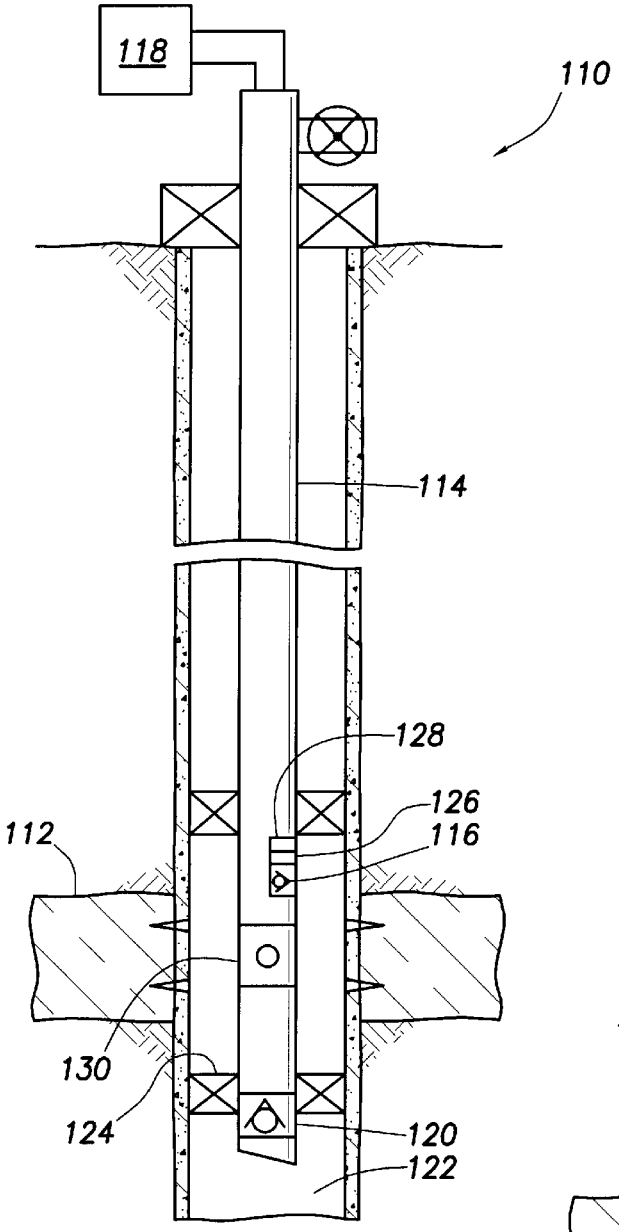
FIG. 7 is a schematic partially cross-sectional view of a third well completion cleanup method embodying principles of the present invention.

Referring additionally now to FIG. 7, another method 110 of performing a completion cleanup operation embodying principles of the present invention is representatively illustrated. In the method 110, a downhole pump is not used to draw completion fluid from a hydrocarbon-bearing producing zone 112. Instead, the completion fluid is permitted to flow into production tubing 114 from the zone 112 via a check valve 116. This method 110 may be utilized where formation pressure in the zone 112 is sufficient to overcome hydrostatic pressure and force the fluid upward through the production tubing 114.

When the completion fluid has flowed to the surface, or to another desired point, such as a subsea wellhead, a pump 118 is used to force the fluid back downwardly through the production tubing 114 and out through a check valve 120 into the rathole 122 below a sump packer 124. From the rathole 122, the fluid flows into a disposal zone (not shown in FIG. 7) as in methods described above. Thus, the method 110 permits use of a powerful surface pump, such as a rig pump, to dispose of the completion fluids in a downhole disposal zone.

A fluid property sensor 126 may be used to detect and monitor properties of fluid flowed through the check valve 116, so that it may be determined when all or substantially all of the completion fluid has been removed from the zone 112. The sensor 126 may be similar to the sensor 46 described above. Additionally, the sensor 126 may be connected to a communication device or transmitter 128 for transmitting fluid property indications from the sensor 126 to a remote location.

Alternatively, the properties or identity of the fluid flowed into the production tubing 114 may be physically checked at the earth's surface, for example, by taking a sample of the fluid, prior to using the pump 118 to pump the fluid back downwardly through the tubing.

The production tubing string 114 may include a valve 130, such as a sliding side door valve, which may be opened to permit production therethrough when the completion cleanup operation is completed. The check valve 120 may be retrieved from the production tubing 114 and replaced with a plug (not shown) to close off the rathole 122 from the interior of the production tubing. Furthermore, the check valve 116, sensor 126 and transmitter 128 may be retrieved from the production tubing 114 after the completion cleanup operation, for example, by initially installing the check valve, sensor and transmitter in a receptacle, such as a side pocket mandrel (not shown).

Figure 8:
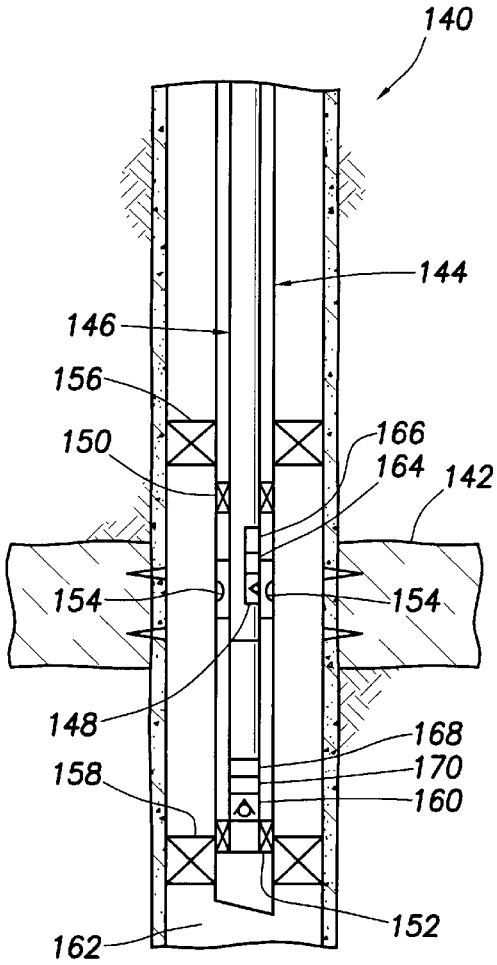
FIG. 8 is a schematic partially cross-sectional view of a fourth well completion cleanup method embodying principles of the present invention.

Referring additionally now to FIG. 8, another method 140 of performing a completion cleanup operation embodying principles of the present invention is representatively illustrated. In the method 140, similar in many respects to the method 110 described above, a downhole pump is not used to draw completion fluid from a hydrocarbon-bearing producing zone 142. Instead, the completion fluid is permitted to flow into production tubing 144 from the zone 142 and then into a tubing string 146, such as a coiled tubing string, via a check valve 148. As with the method 110, the method 140 may be utilized where formation pressure in the zone 142 is sufficient to overcome hydrostatic pressure and force the fluid upward through the tubing string 146.

The tubing string 146 is sealingly received in the production tubing 144 using seals 150, 152 carried externally on the tubing string. When positioned as shown in FIG. 8, the seals 150, 152 axially straddle one or more openings 154 permitting fluid communication through a sidewall of the production tubing 144. Depending upon the well characteristics, the upper seal 150 on the coiled tubing string 146 and/or an upper packer 156 on the production tubing string 144 may not be needed in the method 140. For example, the tubing string 146 may be sealingly received in the production tubing string 144 using only the seal 152 engaged with a conventional packer bore receptacle associated with a sump or production packer 158.

The completion fluid flows into the tubing string 146 via the check valve 148 and then flows upwardly in the tubing string. When the completion fluid has flowed to the surface, or to another desired point, such as a subsea wellhead, a pump connected to the tubing string 146, such as the pump 118 described above, is used to force the fluid back downwardly through the tubing string and out through a check valve 160 into the rathole 162 below the packer 158. From the rathole 162, the fluid flows into a disposal zone (not shown in FIG. 8) as in methods described above. Thus, the method 140 permits use of a powerful surface pump to dispose of the completion fluids in a downhole disposal zone.

A fluid property sensor 164 may be used to detect and monitor properties of fluid flowed through the check valve 148, so that it may be determined when all or substantially all of the completion fluid has been removed from the zone 142. The sensor 164 may be similar to the sensor 46 described above. Additionally, the sensor 164 may be connected to a communication device or transmitter 166 for transmitting fluid property indications from the sensor to a remote location. If the tubing string 146 is coiled tubing, then preferably the transmitter communicates with the remote location using one or more conductors, such as conductors 50 described above, or using acoustic or electromagnetic telemetry.

In addition to, or instead of, the sensor 164 and transmitter 166, the tubing string 146 may include a fluid property sensor 168 to detect and monitor properties of fluid flowed through the lower check valve 160. A communication device or transmitter 170 connected to the sensor 168 may be used to transmit fluid property indications to a remote location, as described above. The transmitter 170 may be a conventional mud pulse telemetry device, such as those generally used in MWD (Measurement While Drilling) systems, since fluid is being pumped outward through the tubing string 146 while the transmitter 170 is communicating the fluid property indications.

Alternatively, the properties or identity of the fluid flowed into the tubing string 146 may be physically checked at the earth's surface, prior to using the pump to pump the fluid back downwardly through the tubing string. This may be the preferred means of identifying the fluid flowed into the tubing string 146 when the tubing string is made up of segmented tubing.

After the completion cleanup operation is completed, the tubing string 146 may be retrieved from the well, the production tubing 144 may be plugged at its lower end, and the well may be placed in production. Thus, the method 140 as described above only requires that a coiled tubing rig be transported to the wellsite to perform the completion cleanup operation. If the tubing string 146 is made up of segmented tubing, the cleanup operation may only require the use of a workover rig.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of performing a well completion cleanup operation, the method comprising the steps of:

flowing completion fluid from a first zone intersected by the well into a tubular string positioned in the well; and displacing the completion fluid from the tubular string into a second zone intersected by the well, with no portion of the fluid being produced to the earth's surface during the flowing and displacing steps.

2. The method according to claim 1, wherein in the flowing and displacing steps, the first and second zones are portions of a single formation.

3. The method according to claim 1, wherein in the flowing and displacing steps, the first and second zones are located in separate formations.

4. The method according to claim 1, wherein the flowing step further comprises pumping the fluid into the tubular string.

5. The method according to claim 4, wherein in the pumping step, the fluid is pumped by a pump included in the tubular string.

6. The method according to claim 5, wherein in the pumping step, the pump is operated by a pump jack at the earth's surface.

7. The method according to claim 5, further comprising the step of automatically displacing formation fluid from the first zone to the earth's surface in response to an indication from a sensor included in the tubular string that substantially all of the completion fluid has been flowed out of the first zone.

8. The method according to claim 5, wherein the pumping step further comprises driving the pump with a motor included in the tubular string.

9. The method according to claim 8, wherein in the driving step, the motor is a hydraulic motor responsive to circulation through the tubular string.

10. The method according to claim 8, wherein in the driving step, the motor is an electric motor coupled to a conductor interconnected between a remote location and the motor.

11. The method according to claim 1, wherein in the flowing and displacing steps, the tubular string is sealingly engaged within a production tubing string disposed within the well.

12. The method according to claim 1, wherein in the flowing and displacing steps, the tubular string is a production tubing string sealingly engaged within the well.

13. The method according to claim 1, wherein the displacing step is performed by a pump positioned at the earth's surface.

14. The method according to claim 1, further comprising the step of sensing a property of fluid flowed through the tubular string in the flowing step.

15. The method according to claim 14, further comprising the step of transmitting an indication of the fluid property to a remote location.

16. The method according to claim 15, wherein the transmitting step is performed by acoustic telemetry.

17. The method according to claim 15, wherein the transmitting step is performed by electromagnetic telemetry.

18. The method according to claim 15, wherein the transmitting step is performed via at least one conductor interconnected between the remote location and a communication device.

19. The method according to claim 1, further comprising the step of sensing a property of fluid flowed through the tubular string in the displacing step.

20. The method according to claim 19, further comprising the step of transmitting an indication of the fluid property to a remote location.

21. The method according to claim 20, wherein the transmitting step is performed by acoustic telemetry.

22. The method according to claim 20, wherein the transmitting step is performed by electromagnetic telemetry.

23. The method according to claim 20, wherein the transmitting step is performed via at least one conductor interconnected between the remote location and a communication device.

24. The method according to claim 20, wherein the transmitting step is performed by mud pulse telemetry.

25. A method of performing a well completion cleanup operation, the well intersecting first and second zones, and the method comprising the steps of:

installing a production tubing string in the well, the production tubing string being sealingly engaged in the well between the first and second zones, and fluid communication being permitted between the first zone and the interior of the production tubing string;

positioning a tubular string sealingly engaged within the production tubing string, the tubular string including a pump; and operating the pump to displace completion fluid from the first zone into the second zone, with no portion of the fluid being produced to the earth's surface during the operating step.

26. The method according to claim 25, wherein the operating step further comprises flowing fluid through a motor connected to the pump.

27. The method according to claim 25, wherein the operating step further comprises circulating fluid through the tubular string.

28. The method according to claim 25, further comprising the step of sensing a property of the completion fluid flowed through the tubular string.

29. The method according to claim 28, further comprising the step of transmitting an indication of the fluid property to a remote location.

30. A method of performing a well completion cleanup operation, the well intersecting first and second zones, the method comprising the step of:

installing a tubular string in the well, the tubular string including a first valve permitting fluid flow from the first zone into the tubular string but restricting fluid flow from the tubular string into the first zone, the tubular string including a second valve permitting fluid flow from the tubular string into the second zone but restricting fluid flow from the second zone into the tubular string, and the tubular string being sealingly engaged in the well between the first and second zones, wherein no portion of the fluid is produced to the earth's surface via either of the first and second valves.

31. The method according to claim 30, further comprising the step of flowing completion fluid from the first zone through the first valve into the tubular string.

32. The method according to claim 31, wherein the flowing step further comprises sensing a property of the completion fluid flowed into the tubular string.

33. The method according to claim 32, further comprising the step of transmitting an indication of the fluid property to a remote location.

34. The method according to claim 31, further comprising the step of retrieving a sample of the completion fluid from the tubular string at the earth's surface.

35. The method according to claim 31, further comprising the step of displacing the completion fluid from the tubular string, through the second valve, and into the second zone.

36. The method according to claim 35, wherein the displacing step further comprises sensing a property of the completion fluid displaced from the tubular string through the second valve.

37. The method according to claim 36, further comprising the step of transmitting an indication of the fluid property to a remote location.

38. A method of performing a well completion cleanup operation, the well intersecting first and second zones, the method comprising the steps of:

installing a production tubing string in the well, the production tubing string being sealingly engaged in the well between the first and second zones;

sealingly engaging a tubular string within the production tubing string, the tubular string including a first valve permitting fluid flow from the first zone through a sidewall of the production tubing string into the tubular string but restricting fluid flow from the tubular string into the first zone, and the tubular string including a second valve permitting fluid flow from the tubular string into the second zone but restricting fluid flow from the second zone into the tubular string; and preventing any portion of the fluid from flowing to the earth's surface.

39. The method according to claim 38, further comprising the step of flowing completion fluid from the first zone, through the first valve, and into the tubular string.

40. The method according to claim 39, wherein the flowing step further comprises sensing a property of the completion fluid flowed into the tubular string.

41. The method according to claim 40, further comprising the step of transmitting an indication of the fluid property to a remote location.

42. The method according to claim 39, further comprising the step of retrieving a sample of the completion fluid from the tubular string at the earth's surface.

43. The method according to claim 39, further comprising the step of displacing the completion fluid from the tubular string, through the second valve, and into the second zone.

44. The method according to claim 43, wherein the displacing step further comprises sensing a property of the completion fluid displaced from the tubular string through the second valve.

45. The method according to claim 44, further comprising the step of transmitting an indication of the fluid property to a remote location.

46. A well completion cleanup system, comprising:

a first tubular string disposed in the well and sealingly engaged therein between first and second zones intersected by the well, completion fluid flowing from the first zone into the first tubular string and then into the second zone, with no portion of the fluid flowing to the earth's surface.

47. The system according to claim 46, further comprising a pump positioned within the first tubular string, the pump pumping the completion fluid into the first tubular string from the first zone, and outward from the first tubular string into the second zone.

48. The system according to claim 47, wherein the pump is included in a second tubular string sealingly received within the first tubular string.

49. The system according to claim 47, wherein the pump is operated by circulation through a motor connected to the pump.

50. The system according to claim 47, wherein the pump is operated by circulation through a second tubular string received within the first tubular string.

51. The system according to claim 47, wherein the pump is operated by an electric motor.

52. The system according to claim 47, wherein the pump is operated by a pump jack.

53. The system according to claim 46, further comprising a sensor sensing a property of the completion fluid flowed into the first tubular string.

54. The system according to claim 53, further comprising a transmitter transmitting an indication of the fluid property to a remote location.

55. The system according to claim 46, further comprising a sensor sensing a property of the completion fluid flowed out of the tubular string.

56. The system according to claim 55, further comprising a transmitter transmitting an indication of the fluid property to a remote location.

57. The system according to claim 46, wherein the first tubular string includes a first valve permitting fluid flow from the first zone into the first tubular string but restricting fluid flow from the first tubular string into the first zone, and the first tubular string further includes a second valve permitting fluid flow from the first tubular string into the second zone but restricting fluid flow from the second zone into the first tubular string.

58. The system according to claim 46, further comprising a second tubular string sealingly engaged within the first tubular string, the second tubular string including a first valve permitting fluid flow from the first zone into the second tubular string but restricting fluid flow from the second tubular string into the first zone, and the second tubular string further including a second valve permitting fluid flow from the second tubular string into the second zone but restricting fluid flow from the second zone into the second tubular string.

* * * * *